US005658152A

United States Patent [19]

Selker

[11] Patent Number: 5,658,152

[45] Date of Patent: Aug. 19, 1997

[54] THREE PRONG SWIVEL PLUG

[75] Inventor: Edwin Joseph Selker, Palo Alto, Calif.

[73] Assignee: International Business Machines Corporation, Armonk, N.Y.

[21] Appl. No.: 483,004

[22] Filed: Jun. 7, 1995

[51] Int. Cl.[6] ..... H01R 39/00

[52] U.S. Cl. ..... 439/31

[58] Field of Search ..... 439/11, 37, 13, 439/18, 20–22

[56] References Cited

U.S. PATENT DOCUMENTS

| | | | |
|---|---|---|---|
| 2,305,101 | 1/1942 | O'Brien | 439/31 |
| 3,137,536 | 6/1964 | Healy | 339/103 |
| 3,335,395 | 8/1967 | Smith | 339/107 |
| 3,718,890 | 2/1973 | Sheldon | 339/107 |
| 3,950,069 | 4/1976 | Wiley | 339/196 |
| 4,006,958 | 2/1977 | Kramer et al. | 339/110 P |
| 4,547,027 | 10/1985 | Scheibenreif | 339/8 R |
| 5,249,970 | 10/1993 | Jennings | 439/31 |

*Primary Examiner*—Gary F. Paumen
*Assistant Examiner*—Christopher Goins
*Attorney, Agent, or Firm*—Baker, Maxham, Jester & Meador

[57] ABSTRACT

A swivel plug is provided which has male and female plug portions which pivot 180° with respect to one another about a common pivot axis between first and second positions. A plurality of male and female electrical contact pairs slidably engage one another and pivot about the common pivot axis. Male and female bodies, which receive the electrical contact pairs, also pivot with respect to one another about the common pivot axis. The male and female bodies and the male and female electrical contact pairs are arranged in a novel relationship to mutually retain one other for the pivotal movement. The swivel plug eliminates the need for an electrical cord between an adapter of a laptop computer and a wall receptacle which has a downwardly located ground receptacle or a wall receptacle which has an upwardly located ground receptacle. The swivel plug also enables plugging a computer adapter or a typical extension cord into a receptacle where there is a rigid space constraint.

37 Claims, 5 Drawing Sheets

94
152
78
158

94
72
XIII
XIII
158
78

72
106
152
100
94
92
70
150
98
104
74
108
96
154
102
58
116
110
114
56
184
84b
84
120
109
92
118
82
68
84a
111
88b
90
186
90
88a
166
148
86b
140
144
86a
164
62
66
142
60
158
160
132
130
156
128
80
78
76

THREE PRONG SWIVEL PLUG

BACKGROUND OF THE INVENTION

1. Field of the Invention

The present invention relates to a swivel plug and more particularly to a male and female plug which are interconnected for pivotal movement 180° with respect to one another, each plug employing a ground contact.

2. Description of the Related Art

Laptop and notebook computers employ an adapter which is sometimes referred to as a "brick" because of its brick-like size and appearance. An electrical cord extends from one end of the adapter to a plug which can be inserted into a receptacle in a side of the computer. At an opposite end of the adapter there is a recessed male three prong connector. A second electrical cord is supplied which has a three prong female plug at one end and a three prong male plug at an opposite end. The female plug of the second electrical cord is plugged into the recessed male plug of the adapter and the three prong male plug of the second electrical cord is typically plugged in a wall receptacle or a power strip. Power can then be supplied to the computer via the adapter.

Laptop and notebook computers should be kept as compact and light as possible because of their intended portability. Elimination of the second cord would improve portability. Substitution of a compact and lightweight connector for the second electrical cord would be desirable for increasing portability. There are several requirements for such a connector. The connector must be capable of plugging the adapter into a down ground prong wall receptacle, an up ground prong wall receptacle, or a power strip. In all instances the connector must properly position the adapter with respect to the wall receptacle or the power strip. Unfortunately, the prior art does not provide such a connector. When a user travels to foreign countries he may be required to carry as many as three different types of second electrical cords because of the different types of wall receptacles. Elimination of these cords would significantly increase portability.

SUMMARY OF THE INVENTION

The present invention provides a three prong swivel plug which eliminates the requirement of the second electrical cord presently supplied with a laptop or notebook computer. The swivel plug has a female plug which plugs into the adapter and a three prong male plug which plugs into a receptacle. The male and female plugs of the swivel plug can rotate 180° with respect to one another. When the three prong male plug of the swivel plug is plugged into a wall receptacle the adapter can be hung in a downward position regardless of the type of wall receptacle. For instance, if the wall receptacle has a downwardly located ground contact the male and female plugs of the swivel plug are rotated so that they are positioned 90° with respect to one another with the ground prong of the male plug downwardly positioned. With this arrangement the adapter is positioned downwardly from the wall receptacle. If the wall receptacle has an upwardly located ground contact then the male and female plugs are rotated 180° with respect to one another so that they are positioned 90° with respect to one another with the ground prong of the male plug positioned upwardly. With this arrangement the adapter still hangs downwardly with respect to the wall receptacle. Further, the swivel plug enables the adapter to be plugged into a power strip even though there are other cords plugged in the power strip. The adapter can be plugged into the power strip with the adapter positioned in an upright position or with the adapter positioned horizontally with the plane of the power strip.

The swivel plug is unique in that the male and female plugs pivot with respect to one another about a pivot axis which is generally perpendicular to the longitudinal axes of the male and female plugs. This requires that both the plug bodies and the electrical contacts retained by the bodies pivot about a common pivot axis. Stops are provided for limiting pivotal movement to 180° and slidable electrical connection is maintained between the male and female contacts throughout the pivotal movement. The three prong swivel plug eliminates the need of the second electrical cord employed by the prior art thereby reducing bulk and weight. When a person travels to foreign countries he or she simply carries three of the three prong swivel plugs instead of carrying three second electrical cords.

While the plug was primarily envisioned for use with a laptop or notebook computer it has other uses such as increasing the versatility of a standard extension cord. As an example, when there is little space near a wall receptacle a standard extension cord can extend straight down when plugged into the wall receptacle via the swivel plug. Without the swivel plug the standard extension cord would make a large bend before extending downwardly. Another example is when it is desirable for a standard extension cord to extend horizontal from a power strip. The cord can extend in either direction from a power strip by orienting the swivel plug in a desired 90° direction. In both of these examples there is less likelihood of an unwanted disconnection since pulling forces perpendicular to the wall receptacle or the power strip receptacle are minimized.

An object of the present invention is to provide a swivel plug which eliminates the necessity of a second electrical cord for plugging an adapter of a laptop or notebook computer into a receptacle.

Another object is to provide a swivel plug which enables an adapter of a laptop or notebook computer to be plugged into a wail receptacle and hang directly downwardly regardless of whether the ground prong of the swivel plug is up or down.

A further object is to provide a swivel plug which enables an adapter of a laptop or notebook computer to extend vertical or horizontal after being plugged into a power strip via the swivel plug.

Still another object is to provide a swivel plug which enables plugging a standard electrical cord into a wall receptacle where there is a small amount of space from the wall.

Still a further object is to provide a swivel plug which orients a standard electrical cord straight up or straight out from a power strip.

Other objects and many of the attendant advantages of the invention will become apparent upon reading the following description taken together with the accompanying drawings.

DESCRIPTION OF THE PREFERRED EMBODIMENTS

Figure 1:
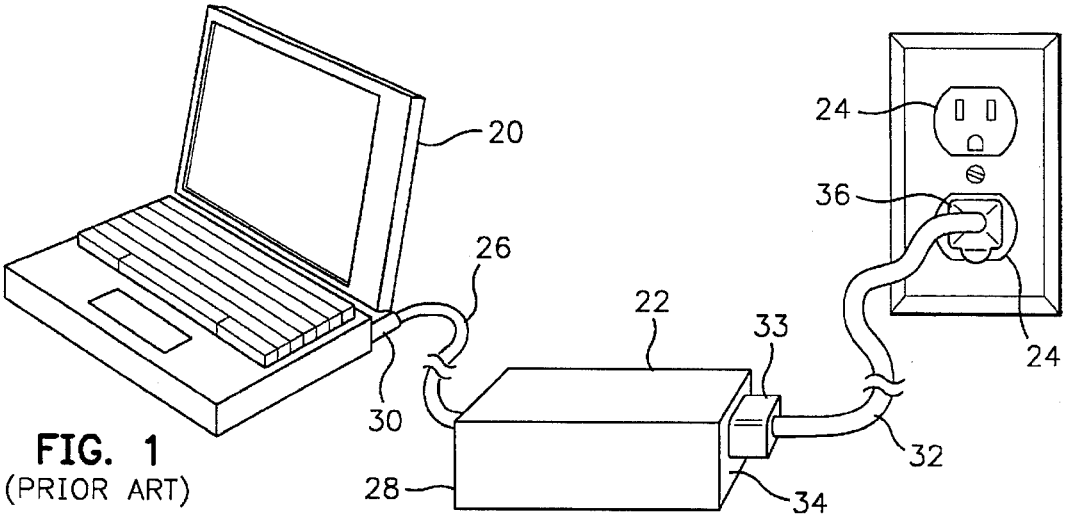
FIG. 1 (PRIOR ART)
FIG. 1 is an isometric prior art illustration of power being supplied to a notebook computer by an adapter and first and second power cords.

Referring now to the drawings wherein like reference numerals designate like or similar parts throughout the several views there is illustrated in FIG. 1 a prior art arrangement of a notebook computer 20 being supplied power by an adapter 22 which is connected to a wall receptacle 24. The adapter 22 is sometimes referred to as a "brick" because of its brick-like size and appearance. A typical power supply includes an electrical cord 26 which is permanently connected to the adapter at one end 28 and which is plugged into the computer 20 at the other end by a plug 30. A second electrical cord 32 has a female plug 33 which is connected to a recessed male connector in the opposite end 34 of the adapter and a male plug 36 which is plugged into a power supply, such as the wall receptacle 24. This prior art arrangement requires the user to carry the second electrical cord 32 which adds additional bulk and weight to his luggage. If the user is traveling in foreign countries he may be required to carry up to three additional electrical cords 32 which are fashioned at their ends for plugging into the foreign power supplies. It would be desirable to eliminate the second electrical cord so as to reduce bulk and weight.

Figure 2:
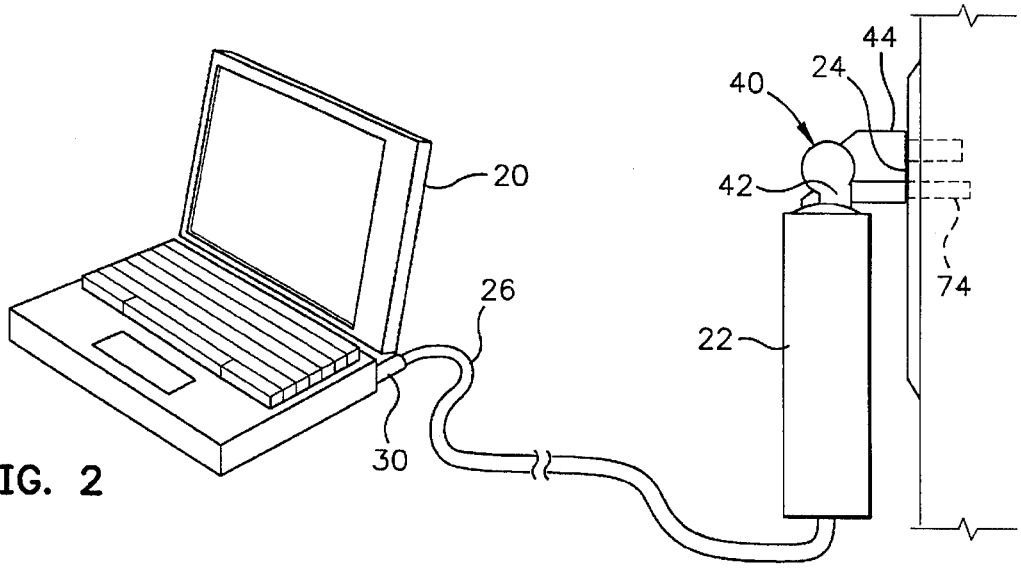
FIG. 2 is an isometric illustration of the present invention where power is supplied to a notebook computer by a swivel connector which connects the adapter to a wall receptacle with the ground plug down.
Figure 3:
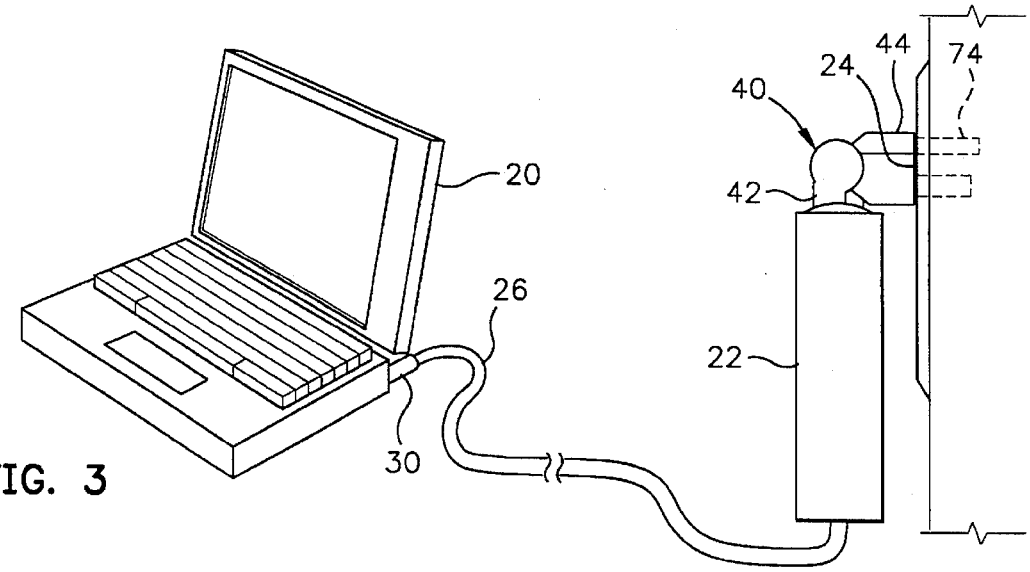
FIG. 3 is the same as FIG. 2 except the ground prong is up.

In FIG. 2 the present invention eliminates the prior art second electrical cord 32 by providing a swivel connector 40 which has a female plug 42 which plugs into the end of the adapter 22 and a male plug 44 which plugs into the wall receptacle 24. When the swivel plug is plugged into a wall receptacle which has a downwardly located ground contact, as shown in FIG. 2, the swivel connect 40 allows the adapter to hang downwardly. When the swivel plug is plugged into a wall receptacle which has an upwardly located ground contact, as shown in FIG. 3, the swivel plug is rotated 180° so that the adapter still hangs downwardly. When the swivel plug is used in the manner shown in FIGS. 2 and 3, the friction between the connecting components of the female plug 42 and the recessed male connection of the adapter is sufficient to support the weight of the adapter in the downward position as shown in the figures.

Figure 4:
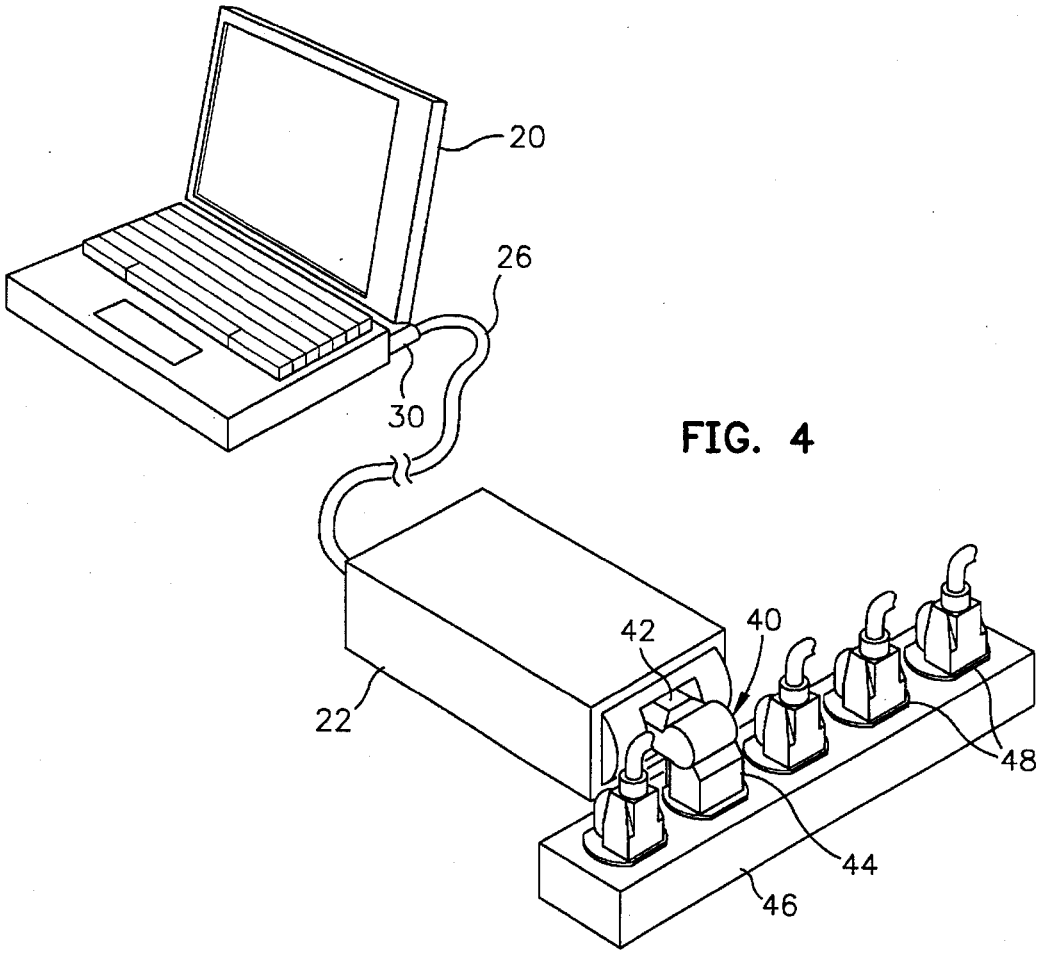
FIG. 4 is an isometric illustration of the present invention connecting the adapter of a notebook computer to a power strip in a horizontal position.
Figure 5:
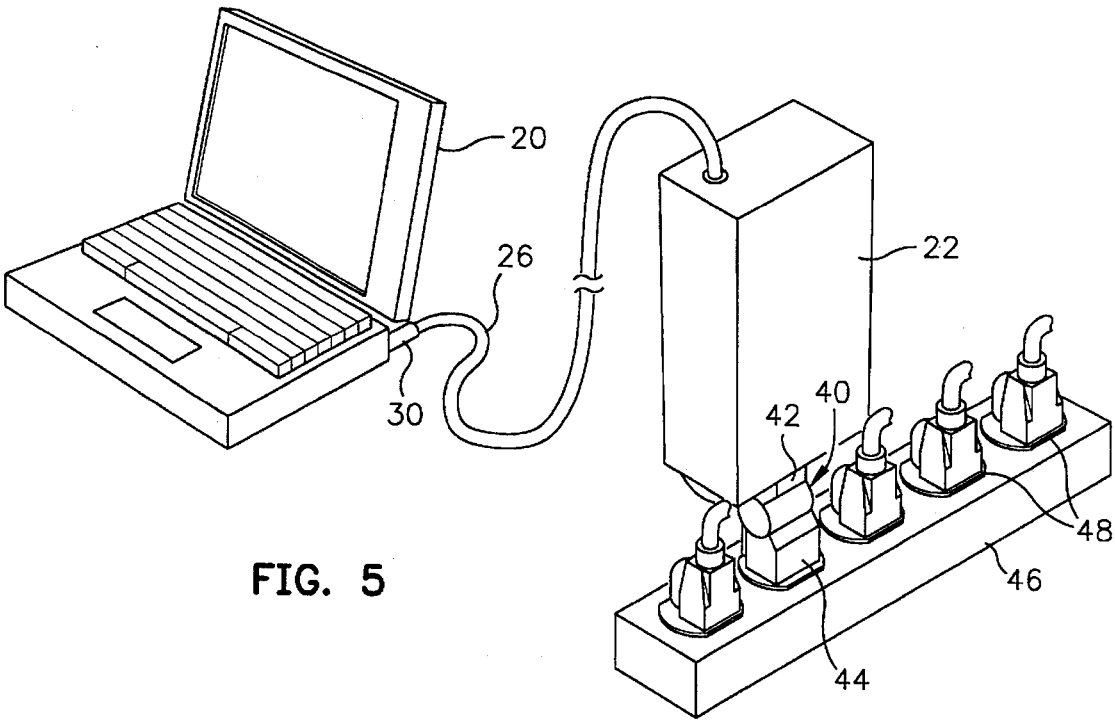
FIG. 5 is an isometric illustration of the present invention connecting the adapter of the notebook computer to a power strip in an upright position.

In FIGS. 4 and 5 the invention is shown plugged into a power strip 46. The power strip has a plurality of receptacles where all of the receptacles 48 may be in use for extension cords except one, as shown in FIG. 4. This leaves insufficient space to position the adapter between adjacent plugs. The swivel plug may be employed to plug the adapter 22 into the power strip so that the adapter is positioned out of the way of adjacent plugs. In FIG. 4 the swivel plug plugs the adapter into the power strip at a 90° angle so that the adapter is positioned horizontally and in FIG. 5 the swivel connector connects the adapter 22 to the power strip in a straight-up vertical position. Accordingly, the present swivel plug emulates the prior art second power cord without the long cord.

Figure 6:
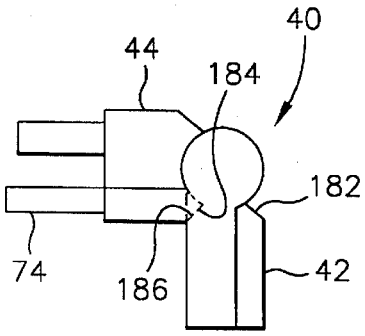
FIG. 6 is a side view of the swivel plug showing the male and female plug portions of the swivel plug stopped in a first 90° position.
Figure 7:
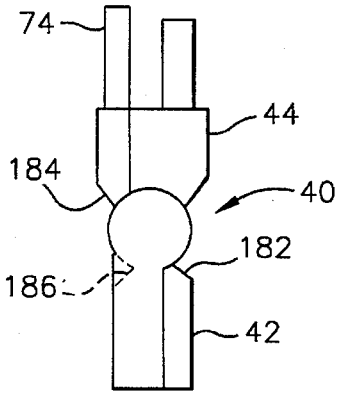
FIG. 7 is a side view of the swivel plug showing the male and female plug portions of the swivel plug in an intermediate aligned position.
Figure 8:
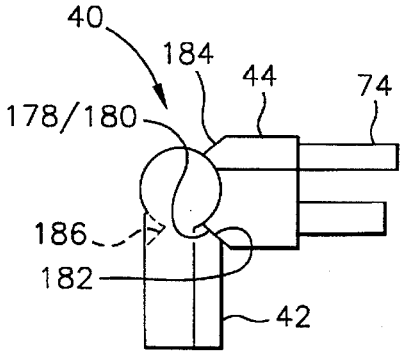
FIG. 8 is a side view of the swivel plug showing the male and female plug portions of the swivel plug stopped in a second 90° position.

FIGS. 6, 7 and 8 are enlarged illustrations of the swivel connector in its three major positions. FIG. 6 shows the swivel connector with the male and female plugs in a first 90° position, FIG. 7 shows the male and female plugs in an aligned vertical intermediate position and FIG. 8 shows the male and female plugs in a second 90° position. The male and female plugs have been rotated a total of 180° between the first and second positions shown in FIGS. 6 and 8. As will be explained hereinafter, the plugs are stopped at the first and second positions by surfaces of the plug bodies which engage one another as shown in FIGS. 6 and 8.

Figure 9:
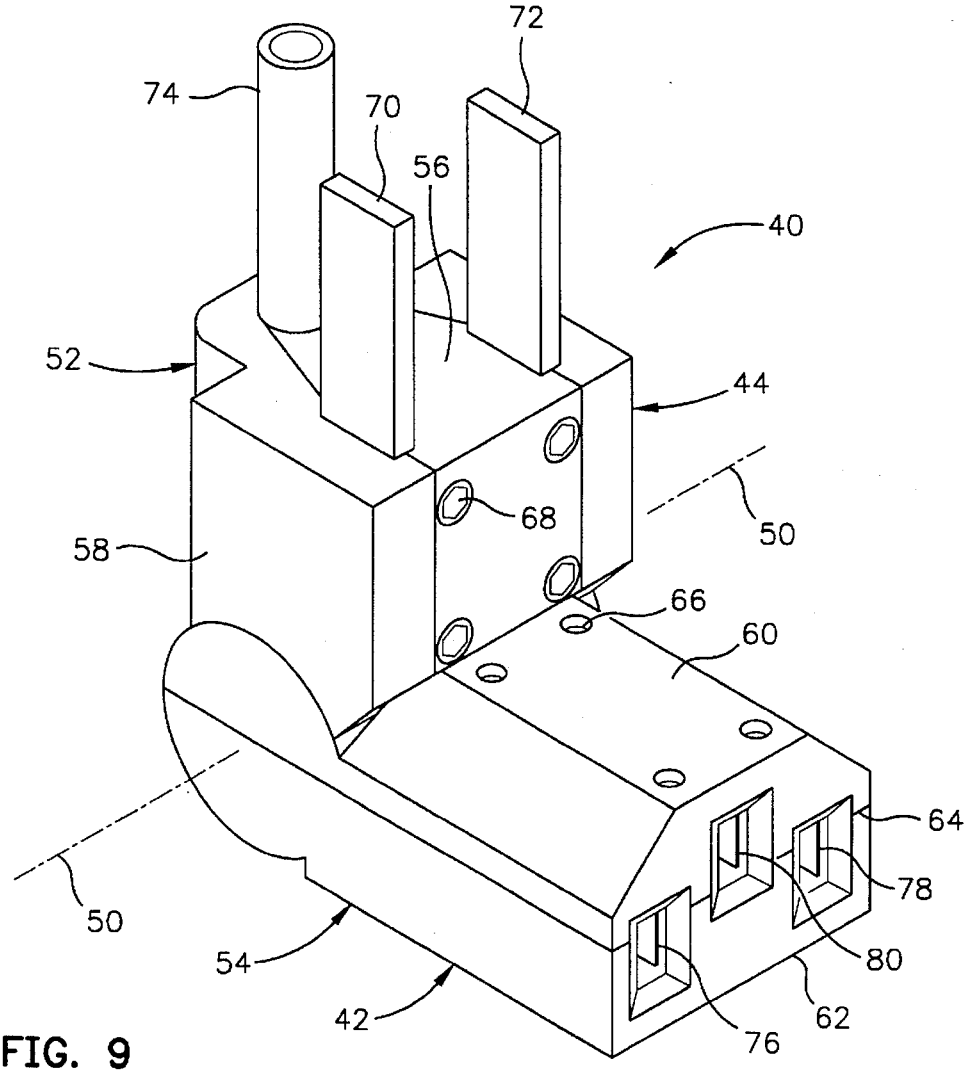
FIG. 9 is an isometric illustration of the male and female plug portions of the swivel plug in one of the 90° positions.

In FIG. 9 the swivel plug 40 is shown with the female plug 42 rotated 90° with respect to the male plug 44. The plugs 42 and 44 are rotatable 180° with respect to one another about a pivot axis 50. The swivel plug 40 includes a first body 52 and a second body 54. The first body 52 has first and second body portions 56 and 58, the first body portion 56 being received within the second body portion 58. The second body 54 has first and second body portions 60 and 62, these two portions making engagement with one another along a plane 64. Screws 66 and 68 may be threaded into the components for retaining the first and second body portions of the first and second bodies 52 and 54. First, second and third electrical male contacts, which will be described in more detail hereinafter, are retained within the first body 52 between the first and second portions 56 and 58 and extend therefrom to provide first, second and third prongs 70, 72 and 74 with the third prong 74 being a ground prong. Female electrical contacts 76, 78 and 80, which will be described in more detail hereinafter, are retained within the second body 54 by the first and second body portions 60 and 62. The male electrical contacts, which provide the prongs 70, 72 and 74, define the extent of a volume which has a triangular cross-section within the second body portion 58. The first body portion 56 has a mating triangular body portion which is received within the second body portion 58 and which retain the male electrical connectors. This will become more clear hereinafter.

Figure 10:
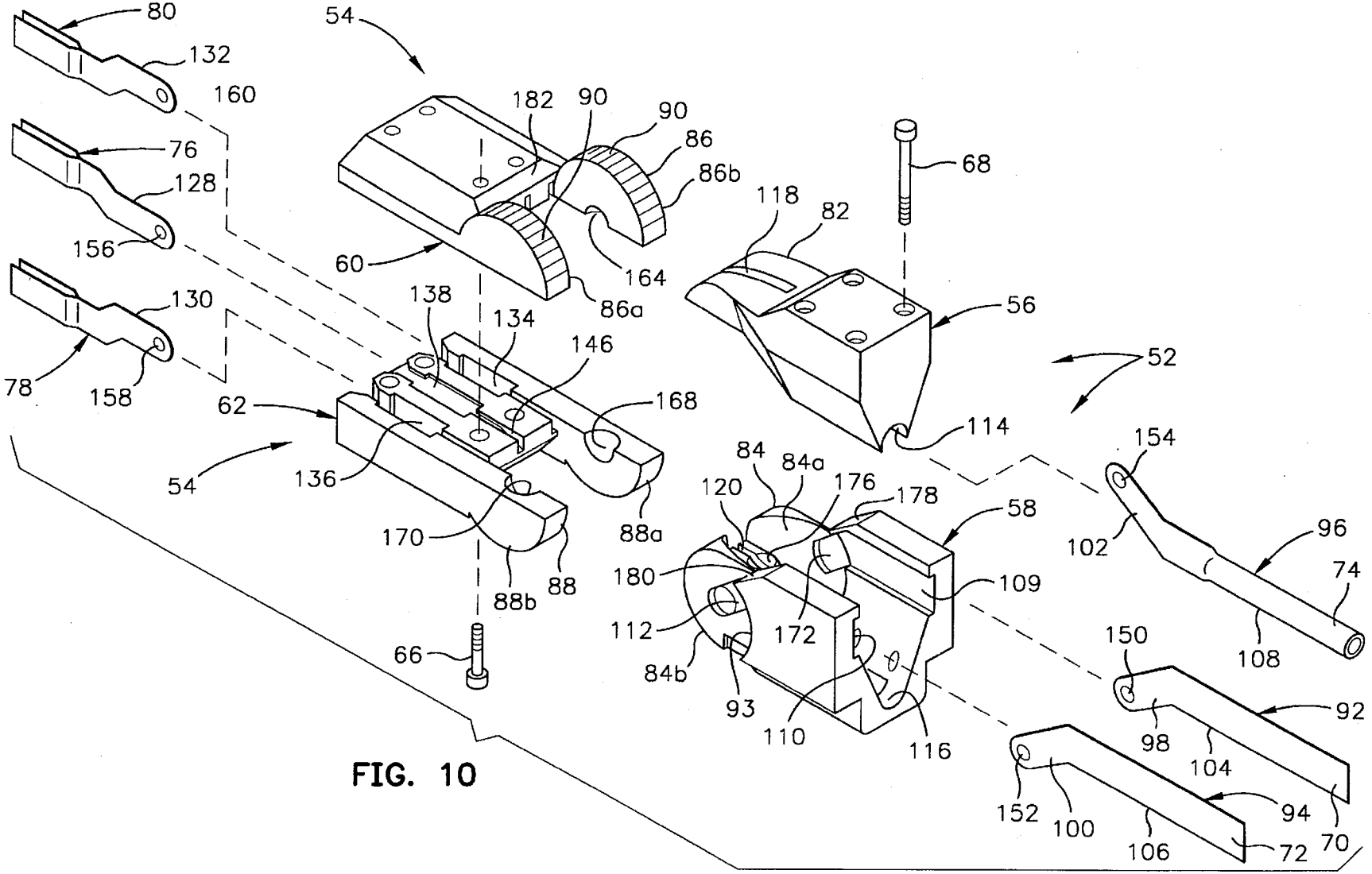
FIG. 10 is an exploded top isometric illustration of the swivel plug.

FIG. 10 illustrates an exploded top isometric view of the swivel plug. The first and second portions 56 and 58 of the first body 52 have axial end portions 82 and 84 which are intersected by the pivotal axis 50 as seen in FIG. 9. The axial end portion 84 is divided into a pair of spaced apart first and second axial end portions **84*a* and 84*b* which snugly receive the axial end portion 82. The first and second body portions 60 and 62 of the second body 54 have axial end portions 86 and 88 which are intersected by the pivotal axis 50 as shown in FIG. 9. The axial end portion 86 includes a pair of spaced apart axial portions 86*a* and 86*b* and the axial end portion 88 includes a pair of axial end portions 88*a* and 88*b*, the axial end portions 86 and 88, when combined together, snugly receiving the axial end portions 82 and 84 of the first body 52. The axial end portions 86*a*, 86*b*, 88*a* and 88*b* may be provided with outwardly facing rounded surfaces which are textured or roughened at 90 so that frictional engagement is increased between these surfaces and arcuate surfaces 92 and 93 on the second body portion 58 of the first body (see also FIG. 11). Male electrical contacts 92, 94 and mentioned hereinabove, provide the prongs 70, 72 and 74 as shown in FIG. 10. The male electrical contacts 92, 94 and 96 have axial end portions 98, 100 and 102 which are intersected by the pivotal axis 50, as seen in FIG. 9, the axial end portions 98 and 100 angling downwardly from middle portions 104 and 106 and the axial end portion 102 angling upwardly from a middle portion 108**.

The second body portion 58 of the second body 52 is provided with a pair of inwardly extending spaced apart elongated slots 109 and 110 and the axial end portion 84 of the second body portion is provided with angled slots 111 and 112 for receiving the middle portions 104 and 106 of the male connectors 92 and 94. The second body portion 58 is further provided with elongated arcuate recesses 114 and 116 for receiving the middle portion 108 of the male connector 96. When generally triangular shaped first body portion 56 is received within the second body portion 58 the male electrical contacts 92, 94 and 96 are held firmly in place with male prong portions 70, 72 and 74 extending therefrom, as illustrated in FIG. 9. The axial end portion 82 of the first body portion 56 is tapered so as to allow axial end portions 84*a* and 84*b* to provide the angled slots 111 and 112. This arrangement also allows outside surfaces of the axial end portions 84*a* and 84*b* to slidably engage inside surfaces of the axial portions 88*a* and 88*b* and 86*a* and 86*b* of the first and second body portions 60 and 62 of the second body 54. The axial end portions 82 and 84 of the first and second body portions 56 and 58 of the first body 52 are provided with vertically oriented slots 118 and 120 for receiving the axial end portion 102 of the ground male connector 96 so that it can transition to the pivotal axis 50.

Figures 11, 12, 13:
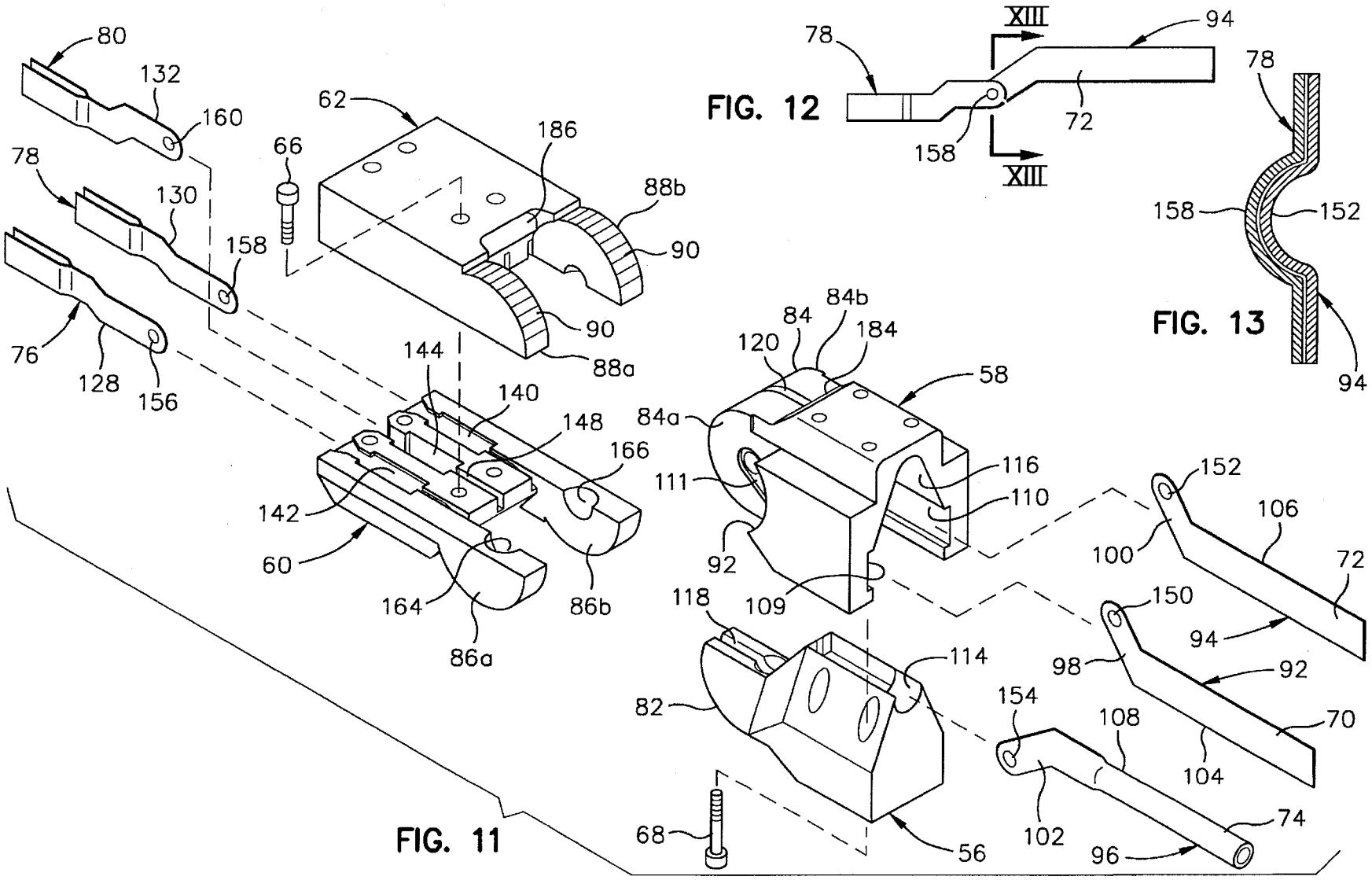
FIG. 11 is an exploded bottom isometric illustration of the swivel plug.
FIG. 12 is a side view of one of the male and female electrical connectors.
FIG. 13 is an enlarged cross-sectional view taken along plane XIII—XIII of FIG. 12.

The female electrical contacts 76, 78 and 80, shown in FIGS. 10 and 11, have axial end portions 128, 130 and 132 which are intersected by the pivotal axis 50, shown in FIG. 9. The first and second body portions 60 and 62 of the second body 54 are provided with elongated slots for receiving the first, second and third female contacts 76, 78 and 80. As seen in FIG. 10, the second body portion 62 is provided with elongated slots 134, 136 and 138 and, as seen in FIG. 11, the first body portion 60 is provided with matching elongated slots 140, 142 and 144 so that when the body portions 60 and 62 are mated the female electrical contacts 76, 78 and 80 are tightly retained by the bodies within the elongated slots. The axial end portions 128 and 130 of the first and second female electrical contacts 76 and 78 angle slightly upwardly while the axial end portion 132 of the female electrical contact 80 angles slightly downwardly toward the pivotal axis 50 (see FIG. 9). This is because the first and second female electrical contacts 76 and 78 are on the same plane while the third female electrical contact 80, which is ground contact, is above that plane as seen in FIG. 10. The second and first body portions 62 and 60 are provided with central slots 146 and 148, as seen in FIGS. 10 and 11, respectively, so that the axial end portion 132 of the female ground connector can transition to the pivotal axis 50, shown in FIG. 9.

It is necessary for the axial end portions 98, 100 and 102 of the male electrical connectors to make electrical connection with the axial end portions 128, 130 and 132 of the female connectors in such a manner that they can slidably rotate about the pivotal axis 50 when the bodies 52 and 54 are rotated about the pivotal axis 50. In the preferred embodiment, dimples are provided on the axial end portions of the male and female electrical connectors along the pivotal axis 50, the dimples protruding from a side of a respective axial end portion and providing a recess on an opposite side of the axial end portion. The axial end portions 98, 100 and 102 of the male electrical connectors may be provided with similar dimples 150, 152 and 154 which are received within recesses of dimples 156, 158 and 160 on the axial end portions 128, 130 and 132 of the female connectors. This can be clearly seen from FIGS. 12 and 13. The pivotal axis 50 intersects substantially the center of each dimple.

In order to receive and retain the male and female electrical contacts in slidable contact with one another along the pivotal axis 50, the protrusions of the dimples 156 and 158 are received within notches on the inside surfaces of the axial portions 86*a*, 86*b*, 88*a* and 88*b* of the first and second body portions 60 and 62 of the second body 54. The axial portions 86*a* and 86*b*, as seen in FIG. 11, have notches 164 and 166, and axial portions 88*a* and 88*b*, as shown in FIG. 10, have notches 168 and 170 so that when the first and second body portions 60 and 62 of the second body 54 are mated together the notches are opposite one another so as to tightly retain the protrusions of the dimples 156 and 158. The axial end portions 84*a* and 84*b* are provided with angled slots one of which is shown at 172 in FIG. 10 for axial end portion 84*a*, for receiving the angled axial end portions 98 and 100 so that the dimples 150 and 152 are positioned for slidable movement about the pivotal axis 50 within the recesses of the dimples 156 and 158 in the axial end portions of the female connectors. In the same manner, the second portion 58 of the first body is provided with a notch 176, as seen in FIG. 10, for receiving the protrusion of the dimple 154 on the axial end portion 102 of the male connector 96.

When the male and female electrical connectors are placed in the recesses in the body portions of the first and second body portions 52 and 54 and the first body 56 is retained within the second portion 58 by the bolts 68 and the first and second body portions 60 and 62 of the second body 54 are mated together and secured by the screws 66, the first and second bodies 52 and 54 and the male and female electrical connectors are rotatable about the pivotal axis 50. It is important to note that the axial end portions 84*a* and 84*b* of the second body portion 58, the axial end portion 82 of the first body 56, the axial end portions 86*a* and 86*b* of the first body portion 60, the axial end portions 88*a* and 88*b* of the second body portion 62, the dimples 150, 152, 154 of the male connectors and the dimples 156, 158 and 160 of the female connectors all cooperate with one another when the components are put together to accomplish two functions: (1) retain the bodies 52 and 54 for rotation about the pivotal axis 50 and (2) maintain electrical contact of the axial end portions of the male electrical connectors and the axial end portions of the female electrical connectors as they rotate about the pivotal axis 50. It should be noted that when the dimples 150 and 152 of the male electrical connectors mate with the dimples 156 and 158 of the female electrical connectors within the notches 164, 166, 168 and 170 of the first and second body portions 60 and 62 that the body portions 52 and 54 are locked together for the desired pivotal action and the aforementioned male and female electrical connectors are locked together for rotation about the pivotal axis 50. As stated hereinabove, the dimple 154 of the male electrical connector, which is ground, recesses within the recess of the dimple 160 of the ground female electrical connector 80 and is retained in slidable engagement with respect thereto within the notch 176. It should be understood that rivets could be employed instead of dimples to provide a protrusion within the aforementioned notches within the body portions 56, 58, 60 and 62 of the first and second bodies 52 and 54. If rivets are employed the heads of the rivets will protrude outwardly to recess within the aforementioned notches 164, 166, 168 and 170.

In FIG. 11 there are shown exterior slanted surfaces 184 and 186 on the body portions 58 and 62 which engage one another and stop pivotal action of the first and second bodies 52 and 54 in the first 90° position shown in FIG. 6. In FIG. 10 there are shown exterior slanted surfaces 178 and 180 on the portion 58 and exterior slanted surface 182 on the body portion 60 which engage one another and stop pivotal action of the bodies 52 and 54 in the second 90° position as shown in FIG. 8. Frictional engagement between the textured surfaces 90 of the portions 60 and 62 and the exterior portions 92 and 94 of the second body portion 58 retain any angular position of the bodies 52 and 54 between the extreme 90° positions shown in FIGS. 6 and 8, such as the intermediate position shown in FIG. 7.

The three prong swivel adapter has provided a unique combination for maintaining connection between the portions of the first and second bodies 52 and 54 and the male and female electrical connectors by a novel combination and cooperation between these components. It is to be understood that the body portions 56, 58, 60 and 62 of the first and second bodies 52 and 54 are made of an insulation material such as plastic. The male and female electrical connectors may be made of a suitable conductive material such as brass or copper.

Obviously, other embodiments and modifications of the invention will occur to those of ordinary skill in the art in view of these teachings. Therefore, the invention is to be limited only by the following claims which include all such embodiments and modifications when viewed in conjunction with the above specifications and accompanying drawings.

We claim:

1. An electrical swivel plug comprising:

first and second bodies, each body having a longitudinal axis;

means interconnecting the first and second bodies for pivotal movement with respect to one another about a pivotal axis which is substantially perpendicular to a plane which includes the longitudinal axis of each body;

the first body having a plurality of elongated slots which are substantially parallel to its longitudinal axis;

a plurality of male electrical contacts located in the slots of the first body and extending therefrom as prongs to form a male plug;

the second body having a plurality of elongated slots which are substantially parallel to its longitudinal axis;

a plurality of female electrical contacts located in the slots of the second body and substantially contained therein to form a female plug;

means for joining the male and female electrical contacts for pivotal movement with respect to one another about said pivotal axis; and said means for interconnecting the first and second bodies for pivotal movement including:

each electrical contact having laterally extending protrusions which extend therefrom and are aligned in a spaced relationship with respect to one another along said pivotal axis; and the bodies having recesses which are aligned in a spaced relationship with respect to one another along said pivotal axis; and each recess receiving a respective protrusion.

2. An electrical swivel plug as claimed in claim 1 including:

the first and second bodies being fashioned with surfaces which engage one another for stopping pivotal movement of the first and second bodies at first and second positions which are substantially 180° apart and each of the first and second positions positioning the first and second bodies with their longitudinal axes substantially 90° apart.

3. An electrical swivel plug as claimed in claim 1 including:

the first and second bodies having surfaces which slide with respect to one another upon pivotal action of the bodies; and at least some of the surfaces being textured.

4. An electrical swivel plug as claimed in claim 1 including:

each of the first and second bodies having first and second portions;

the first portion of the first body being received within the second portion of the first body;

the first portion of the second body making substantially planar engagement with the second portion of the second body;

the first portion of the first body having an axial end portion and the first portion of the second body having a pair of spaced apart axial end portions, the axial end portions being intersected by said pivotal axis;

the axial end portion of the first portion of the first body being received within the pair of axial end portions of the first portion of the second body.

5. An electrical swivel plug as claimed in claim 1 including:

the second portion of the first body having spaced apart tapered axial end portions which are intersected by said pivotal axis;

the second portion of the second body having a pair of spaced apart axial end portions which are intersected by said pivotal axis;

the axial end portion of the first portion of the first body being tapered and being received by the tapered axial end portions of the second portion of the first body; and the tapered axial end portions of the second body portion of the first body and the axial end portions of the second body retaining the dimples within the recesses of the axial end portions of the male and female electrical contacts.

6. An electrical swivel plug as claimed in claim 1 including:

each of said plurality of male electrical contacts and said female electrical contacts comprising first, second and third electrical contacts, the third electrical contact being a ground electrical contact; and each of the first, second and third electrical contacts having an axial end portion which is intersected by said pivotal axis.

7. An electrical swivel plug as claimed in claim 1 including:

the second portion of the first body having an elongated cavity which has a substantially triangular cross section;

each of the first, second and third male electrical contacts comprising said axial end portion, said prong portion and a middle portion interconnecting the axial end portion and prong portion; and each of the middle portions of the first, second and third male electrical contacts being elongated with a respective longitudinal axis;

the longitudinal axes of the middle portions of the first, second and third male electrical contacts defining extents of the triangular cross section of the elongated cavity in the second portion of first body;

the first portion of the first body having a triangular portion which is received within the cavity of the second portion of the first body.

8. An electrical swivel plug as claimed in claim 6 including:

the axial end portion of each made electrical portion contact angling from the respective middle portion of each male electrical contact to said pivotal axis.

9. An electrical swivel plug as claimed in claim 6 including:

each of the first and second bodies having first and second portions;

the first portion of the first body being received within the second portion of the first body;

the first portion of the second body making substantially planar engagement the second portion of the second body;

the first portion of the first body having an axial end portion and the first portion of the second body having a pair of spaced apart axial end portions, the axial end portions being intersected by said pivotal axis;

the axial end portion of the first portion of the first body being received within the pair of axial end portions of the first portion of the second body.

10. An electrical swivel plug as claimed in claim 9 including:

each of the first and second bodies having first and second portions;

the first portion of the first body being received within the second portion of the first body;

the first portion of the first body having an axial end portion and the first portion of the second body having a pair of spaced apart axial end portions, the axial end portions being intersected by said pivotal axis;

the axial end portion of the first portion of the first body being received within the pair of axial end portions of the first portion of the second body.

11. An electrical swivel plug as claimed in claim 9 including: the second portion of the first body having elongated slots for receiving the axial end portions of the first and second male electrical contacts and the axial end portions of the first and second body portions of the second body having elongated slots for receiving the axial end portions of the first and second female electrical contacts.

12. An electrical swivel plug as claimed in claim 11 including:

the axial end portion of the first portion of the first body having a slot for receiving the axial end portions of the third male and female electrical contacts.

13. An electrical swivel plug as claimed in claim 12 including:

the second portion of the first body having an elongated cavity which has a substantially triangular cross section;

each of the first, second and third male electrical contacts comprising said axial end portion, said prong portion and a middle portion interconnecting the axial end portion and prong portion; and each of the middle portions of the first, second and third male electrical contacts being elongated with a respective longitudinal axis;

the longitudinal axes of the middle portions of the first, second and third male electrical contacts defining extents of the triangular cross section of the elongated cavity in the second portion of first body;

the first portion of the first body having a triangular portion which is received within the cavity of the second portion of the first body.

14. An electrical swivel plug as claimed in claim 13 wherein said means for joining the male and female electrical contacts includes:

the axial end portions of the male or female electrical contacts having recesses and the axial end portions of the other of the male and female electrical contacts having dimples which are recessed in the recesses, said dimples being said laterally extending protrusions;

all of the dimples and all of the recesses being located substantially along the pivotal axis of the electrical contacts; and the first and second bodies retaining the dimples within the recesses.

15. An electrical swivel plug as claimed in claim 14 including:

the second portion of the first body having spaced apart tapered axial end portions which are intersected by said pivotal axis;

the second portion of the second body having a pair of spaced apart axial end portions which are intersected by said pivotal axis;

the axial end portion of the first portion of the first body being tapered and being received by the tapered axial end portions of the second portion of the first body; and the tapered axial end portions of the second body portion of the first body and the axial end portions of the second body retaining the dimples within the recesses of the axial end portions of the male and female electrical contacts.

16. An electrical swivel plug as claimed in claim 15 including: the axial end portion of each male electrical contact angling from the respective middle portion of each male electrical contact to said pivotal axis.

17. An electrical swivel plug as claimed in claim 16 including:

the first and second bodies having surfaces which slide with respect to one another upon pivotal action of the bodies; and at least some of the surfaces being textured for increased friction between the surfaces of the bodies upon pivotal action therebetween.

18. An electrical swivel plug as claimed in claim 17 including:

the first and second bodies being fashioned with surfaces which engage one another for stopping pivotal movement of the first and second bodies at first and second positions which are substantially 180° apart and each of the first and second positions positioning the first and second bodies with their longitudinal axes substantially 90° apart.

19. An electrical swivel plug comprising:

first and second bodies, each body having a longitudinal axis;

means interconnecting the first and second bodies for pivotal movement with respect to one another about a pivotal axis which is substantially perpendicular to a plane which includes the longitudinal axis of each body;

the first body having a plurality of elongated slots which are substantially parallel to its longitudinal axis;

a plurality of male electrical contacts located in the slots of the first body and extending therefrom as prongs to form a male plug;

the second body having a plurality of elongated slots which are substantially parallel to its longitudinal axis;

a plurality of female electrical contacts located in the slots of the second body and substantially contained therein to form a female plug;

means for joining the male and female electrical contacts for pivotal movement with respect to one another about a pivotal axis which is common with the pivotal axis of the first and second bodies;

said means for interconnecting the first and second bodies for pivotal movement including:

each electrical contact having laterally extending protrusions which extend therefrom along said pivotal axis; and the bodies having recesses along said pivotal axis which receive the protrusions; said means for joining the male and female electrical contacts including:

each of the male and female electrical contacts having an axial end portion which is intersected by said pivotal axis;

the axial end portions of the male or female electrical contacts having recesses and the axial end portions of the other of the male and female electrical contacts having dimples which are recessed in the recesses, said dimples being said laterally extending protrusions;

all of the dimples and all of the recesses being located substantially along the pivotal axis of the electrical contacts; and the first and second bodies retaining the dimples within the recesses.

20. An electrical swivel plug as claimed in claim 19 including:

the first and second bodies being fashioned with surfaces which engage one another for stopping pivotal movement of the first and second bodies at first and second positions which are substantially 180° apart and each of the first and second positions positioning the first and second bodies with their longitudinal axes substantially 90° apart.

21. An electrical swivel plug as claimed in claim 19 including:

the first and second bodies having surfaces which slide with respect to one another upon pivotal action of the bodies; and at least some of the surfaces being textured.

22. An electrical swivel plug as claimed in claim 19 including:

each of the first and second bodies having first and second portions;

the first portion of the first body being received within the second portion of the first body;

the first portion of the second body making substantially planar engagement with the second portion of the second body;

the first portion of the first body having an axial end portion and the first portion of the second body having a pair of spaced apart axial end portions, the axial end portions being intersected by said pivotal axis; and the axial end portion of the first portion of the first body being received within the pair of axial end portions of the first portion of the second body.

23. An electrical swivel plug comprising:

first and second bodies, each body having a longitudinal axis;

means interconnecting the first and second bodies for pivotal movement with respect to one another about a pivotal axis which is substantially perpendicular to a plane which includes the longitudinal axis of each body;

the first body having a plurality of elongated slots which are substantially parallel to its longitudinal axis;

a plurality of male electrical contacts located in the slots of the first body and extending therefrom as prongs to form a male plug;

the second body having a plurality of elongated slots which are substantially parallel to its longitudinal axis;

a plurality of female electrical contacts located in the slots of the second body and substantially contained therein to form a female plug;

means for joining the male and female electrical contacts for pivotal movement with respect to one another about a pivotal axis which is common with the pivotal axis of the first and second bodies;

each of the first and second bodies having first and second portions;

the first portion of the first body being received within the second portion of the first body;

the first portion of the second body making substantially planar engagement with the second portion of the second body;

the first portion of the first body having an axial end portion and the first portion of the second body having a pair of spaced apart axial end portions, the axial end portions being intersected by said pivotal axis;

the axial end portion of the first portion of the first body being received within the pair of axial end portions of the first portion of the second body; and said means for joining the male and female electrical contacts including:

each of the male and female electrical contacts having an axial end portion which is intersected by said pivotal axis;

the axial end portions of the male or female electrical contacts having recesses and the axial end portions of the other of the male and female electrical contacts having dimples which are recessed in the recesses;

all of the dimples and all of the recesses being located substantially along the pivotal axis of the electrical contacts; and the first and second bodies retaining the dimples within the recesses.

24. An electrical swivel plug as claimed in claim 23 including:

the second portion of the first body having spaced apart tapered axial end portions which are intersected by said pivotal axis;

the second portion of the second body having a pair of spaced apart axial end portions which are intersected by said pivotal axis;

the axial end portion of the first portion of the first body being tapered and being received by the tapered axial end portions of the second portion of the first body; and the tapered axial end portions of the second body portion of the first body and the axial end portions of the second body retaining the dimples within the recesses of the axial end portions of the male and female electrical contacts.

25. An electrical swivel plug comprising:

first and second bodies, each body having a longitudinal axis;

means interconnecting the first and second bodies for pivotal movement with respect to one another about a pivotal axis which is substantially perpendicular to a plane which includes the longitudinal axis of each body;

the first body having a plurality of elongated slots which are substantially parallel to its longitudinal axis;

a plurality of male electrical contacts located in the slots of the first body and extending therefrom as prongs to form a male plug;

the second body having a plurality of elongated slots which are substantially parallel to its longitudinal axis;

a plurality of female electrical contacts located in the slots of the second body and substantially contained therein to form a female plug;

means for joining the male and female electrical contacts for pivotal movement with respect to one another about a pivotal axis which is common with the pivotal axis of the first and second bodies;

each of said plurality of male electrical contacts and said female electrical contacts comprising first, second and third electrical contacts, the third electrical contact being a ground electrical contact;

each of the first, second and third electrical contacts having an axial end portion which is intersected by said pivotal axis;

the second portion of the first body having an elongated cavity which has a substantially triangular cross section;

each of the first, second and third male electrical contacts comprising said axial end portion, said prong portion and a middle portion interconnecting the axial end portion and prong portion; and each of the middle portions of the first, second and third male electrical contacts being elongated with a respective longitudinal axis;

the longitudinal axes of the middle portions of the first, second and third male electrical contacts defining extents of the triangular cross section of the elongated cavity in the second portion of first body; and the first portion of the first body having a triangular portion which is received within the cavity of the second portion of the first body.

26. An electrical swivel plug as claimed in claim 25 including:

the axial end portion of each male electrical contact angling from the respective middle portion of each male electrical contact to said pivotal axis.

27. An electrical swivel plug comprising:

first and second bodies, each body having a longitudinal axis;

means interconnecting the first and second bodies for pivotal movement with respect to one another about a pivotal axis which is substantially perpendicular to a plane which includes the longitudinal axis of each body;

the first body having a plurality of elongated slots which are substantially parallel to its longitudinal axis;

a plurality of male electrical contacts located in the slots of the first body and extending therefrom as prongs to form a male plug;

the second body having a plurality of elongated slots which are substantially parallel to its longitudinal axis;

a plurality of female electrical contacts located in the slots of the second body and substantially contained therein to form a female plug;

means for joining the male and female electrical contacts for pivotal movement with respect to one another about a pivotal axis which is common with the pivotal axis of the first and second bodies;

each of said plurality of male electrical contacts and said female electrical contacts comprising first, second and third electrical contacts, the third electrical contact being a ground electrical contact;

each of the first, second and third electrical contacts having an axial end portion which is intersected by said pivotal axis;

each of the first and second bodies having first and second portions;

the first portion of the first body being received within the second portion of the first body;

the first portion of the second body making substantially planar engagement with the second portion of the second body;

the first portion of the first body having an axial end portion and the first portion of the second body having a pair of spaced apart axial end portions, the axial end portions being intersected by said pivotal axis; and the axial end portion of the first portion of the first body being received within the pair of axial end portions of the first portion if the second body.

28. An electrical swivel plug as claimed in claim 27 including:

each of the first and second bodies having first and second portions;

the first portion of the first body being received within the second portion of the first body;

the first portion of the first body having an axial end portion and the first portion of the second body having a pair of spaced apart axial end portions, the axial end portions being intersected by said pivotal axis; and the axial end portion of the first portion of the first body being received within the pair of axial end portions of the first portion of the second body.

29. An electrical swivel plug as claimed in claim 27 including:

the second portion of the first body having elongated slots for receiving the axial end portions of the first and second male electrical contacts and the axial end portions of the first and second body portions of the second body having elongated slots for receiving the axial end portions of the first and second female electrical contacts.

30. An electrical swivel plug as claimed in claim 29 including:

the axial end portion of the first portion of the first body having a slot for receiving the axial end portions of the third male and female electrical contacts.

31. An electrical swivel plug as claimed in claim 30 wherein the means for joining the first and second bodies for pivotal movement includes:

each electrical contact having laterally extending protrusions which extend therefrom substantially along said pivotal axis; and the bodies having recesses which receive the protrusions.

32. An electrical swivel plug as claimed in claim 31 including:

the second portion of the first body having an elongated cavity which has a substantially triangular cross section;

each of the first, second and third male electrical contacts comprising said axial end portion, said prong portion and a middle portion interconnecting the axial end portion and prong portion;

each of the middle portions of the first, second and third male electrical contacts being elongated with a respective longitudinal axis;

the longitudinal axes of the middle portions of the first, second and third male electrical contacts defining extents of the triangular cross section of the elongated cavity in the second portion of first body; and the first portion of the first body having a triangular portion which is received within the cavity of the second portion of the first body.

33. An electrical swivel plug as claimed in claim 32 wherein said means for joining the male and female electrical contacts includes:

the axial end portions of the male or female electrical contacts having recesses and the axial end portions of the other of the male and female electrical contacts having dimples which are recessed in the recesses, said dimples being said laterally extending protrusions;

all of the dimples and all of the recesses being located substantially along the pivotal axis of the electrical contacts; and the first and second bodies retaining the dimples within the recesses.

34. An electrical swivel plug as claimed in claim 33 including:

the second portion of the first body having spaced apart tapered axial end portions which are intersected by said pivotal axis;

the second portion of the second body having a pair of spaced apart axial end portions which are intersected by said pivotal axis;

the axial end portion of the first portion of the first body being tapered and being received by the tapered axial end portions of the second portion of the first body; and the tapered axial end portions of the second body portion of the first body and the axial end portions of the second body retaining the dimples within the recesses of the axial end portions of the male and female electrical contacts.

35. An electrical swivel plug as claimed in claim 34 including:

the axial end portion of each male electrical contact angling from the respective middle portion of each male electrical contact to said pivotal axis.

36. An electrical swivel plug as claimed in claim 35 including:

the first and second bodies having surfaces which slide with respect to one another upon pivotal action of the bodies; and at least some of the surfaces being textured for increased friction between the surfaces of the bodies upon pivotal action therebetween.

37. An electrical swivel plug as claimed in claim 36 including:

the first and second bodies being fashioned with surfaces which engage one another for stopping pivotal movement of the first and second bodies at first and second positions which are substantially 180° apart and each of the first and second positions positioning the first and second bodies with their longitudinal axes substantially 90° apart.

* * * * *

UNITED STATES PATENT AND TRADEMARK OFFICE

CERTIFICATE OF CORRECTION

PATENT NO. : 5,658,152

DATED : August 19, 1997

INVENTOR(S) : Selker

It is certified that error appears in the above-indentified patent and that said Letters Patent is hereby corrected as shown below:

Column 9, line 15, change "made" to --male-- and delete "portion".

Signed and Sealed this

Seventeenth Day of February, 1998

*Attest:*

*Attesting Officer*

BRUCE LEHMAN

*Commissioner of Patents and Trademarks*